United States Patent [19]

Baer

[11] Patent Number: 4,999,878

[45] Date of Patent: Mar. 19, 1991

[54] THRUST BEARING ASSEMBLY IN A PINLESS HINGE STRUCTURE

[76] Inventor: Austin R. Baer, 1115 N. Ellsworth, Villa Park, Ill. 60181

[21] Appl. No.: 443,561

[22] Filed: Nov. 29, 1989

[51] Int. Cl.[5] ..... E05D 7/00

[52] U.S. Cl. ..... 16/354; 16/DIG. 27

[58] Field of Search ..... 16/273, 354, 380, DIG. 27

[56] References Cited

U.S. PATENT DOCUMENTS 3,402,422 9/1968 Baer ..... 16/354

*Primary Examiner*—Richard K. Seidel

*Assistant Examiner*—Carmine Cuda

*Attorney, Agent, or Firm*—Gravely, Lieder & Woodruff

[57] ABSTRACT

A thrust bearing assembly for a pinless hinge structure having two longitudinally extending hinge members which are rotatory joined to each other and a longitudinally extending clamp member. The thrust bearing assembly includes a thrust bearing member having multiple bearing support surfaces which are longitudinally joined to each other. Each bearing surface is preferably non metallic and extends laterally across adjacent longitudinal edges of the hinge members to inhibit relative longitudinal movement between the hinge members.

15 Claims, 2 Drawing Sheets

THRUST BEARING ASSEMBLY IN A PINLESS HINGE STRUCTURE

FIELD OF THE INVENTION

The present invention generally relates to pinless hinge structures, and more particularly, to an improved thrust bearing assembly for inhibiting relative longitudinal movement between hinge members of a pinless hinge structure.

BACKGROUND OF THE INVENTION

A hinge structure typically includes two hinge members which are rotatably secured together by a pin or the like. Automatically operated doors, such as those used at shopping centers, schools, or the like are continually operated and are substantially heavier and larger than those used in most homes. As will be understood, continual use of the door submits the hinge structure to extensive wear. Notwithstanding their continual use and the substantial load placed thereon, a hinge structure is expected to perform error-free and with minimum maintenance.

Increases in height and/or weight of the door or the like carried by the hinge members, adds to the frictional sliding contact between the hinge members and thereby increases the wear on the hinge structure. As may be appreciated, and despite the wear on such hinge structures, the hinge members are not normally permitted to longitudinally move relative to each other during operation.

My U.S. Pat. No. 3,092,870, dated June 11, 1963, discloses a pinless hinge structure offering increased performance and durability. Such a hinge structure includes two longitudinally extending hinge members which are rotatably joined along adjacent longitudinal edges by mutually intermeshing gear segments forming part of the hinge members. A clamp member maintains the gear segments in mesh relative to each other while permitting smooth and uniform movement of the hinge members through a full arc of travel of the hinge.

The design and performance of the hinge structure disclosed in the above-identified patent was further enhanced through the provision of a longitudinal thrust bearing which was the subject of my U.S. Pat. No. 3,402,422, dated Sept. 24, 1968. My patented longitudinal thrust bearing comprises an essentially solid bearing member disposed in longitudinally coextensive recesses formed in adjacent longitudinal edges of each rotatable hinge member. The longitudinal dimensions of the bearing member and the recesses in which the bearing member is disposed are such that upper and lower surfaces of the recesses slidably contact upper and lower bearing surfaces of the bearing member disposed therein whereby inhibiting longitudinal movement of one hinge member with respect to the other hinge member.

Several thrust bearings are typically arranged along the length of the hinge structure. Providing several thrust bearings along the length of the door, however, increases both labor and material costs involved in assembling and fabricating the hinge structure. As will be appreciated, each additional thrust bearing member increases the material costs involved in fabricating the hinge structure.

Since the thrust bearings used in a pinless hinge structure are not subject to direct compression loading, as in the case of conventional hinges having interlocking knuckles, the longitudinal length of each lateral recess and corresponding length of each thrust bearing is partially determined by the cantilevered loading applied to each thrust bearing. It has been found that insufficient length of the thrust bearing will result in twisting of the thrust bearing as it transfers the load across the adjacent lateral recesses in the opposing hinge members. To maximize the load bearing capability of a thrust bearing for a pinless hinge structure, it is desirable that the ratio of the longitudinal dimension of the thrust bearing is increased relative to the width of the thrust bearing. Increasing the longitudinal dimension of the thrust bearing, however, involves removal of additional material from the hinge members which adversely affects the lateral strength of the hinge structure.

Because of the continual relative sliding engagement between the hinge members and bearing surfaces, such thrust bearings do, on occasion, require replacement. Replacement of any or all of the thrust bearings normally requires complete disassembly of the hinge structure from the associated door. As will be appreciated, repairs in a door leading to a commonly-frequented building such as a school, hospital, or the like interrupts or limits accessibility to such a building.

Even if only for a short time period, such interruptions to building access are undesirable and, therefore, should be maintained to a minimum, if not eliminated. As will be appreciated, the ability to extend wearability of the hinge structure will reduce maintenance costs, repairs, and thereby improve hinge performance.

SUMMARY OF THE INVENTION

In view of the above, and in accordance with the present invention, there is provided a thrust bearing assembly for a hinge structure having two longitudinally extending hinge members and a longitudinally extending clamp member. The two hinge members are rotatably joined to each other in a manner permitting smooth and uniform movement through a full arc of travel of the hinge structure. The thrust bearing assembly includes a one-piece thrust bearing member having multiple and substantially corresponding bearing support surfaces which are joined longitudinally to each other. Each bearing support surface extends laterally across adjacent longitudinal edges of the hinge members to inhibit relative longitudinal movement between the hinge members.

In a preferred form of the invention, the hinge members of the hinge structure are rotatably joined along their adjacent longitudinal edges by gear segments which are maintained in intermeshing engagement by the clamp member. The clamp member is configured with longitudinally extending, inwardly turned ends about which the hinge members rotate.

The thrust bearing member has a series of longitudinally spaced, lateral projections which extend through a series of longitudinally spaced lateral recesses defined along adjacent edges of the hinge member. Each projection extends across the gear segments of the hinge member in a manner inhibiting relative longitudinal movement of the hinge members. Each projection on the thrust bearing member defines a pair of longitudinal channels which accommodate the inwardly turned ends of the clamp member. Preferably, the thrust bearing member is formed from a non-metallic material for reducing frictional contact between it and the hinge members thereby advantageously increasing the durability of the bearing assembly. If desired, the thrust bearing member may be releasably secured to the clamp member as with any suitable device.

Each lateral projection on the thrust bearing member is joined to another by a web. The web is sufficiently strong enough to resist breakage from the cantilevered forces applied to the lateral projections by the hinge members. Preferably, the web is formed with concave surfaces which match the curvature of and receive the gear segments of the hinge members.

As compared to my previous and patented thrust bearing, the thrust bearing member of the present invention has an increased ratio of length to the internal dimension of the clamp member, and it is the clamp member which the bearings of a pinless hinge contact to derive stability. In short, the clamp member of a pinless hinge confines the bearings and thus resists twisting in the bearings. The extended length enables the bearing member to maintain better alignment, whereas the multiple projections provide an aggregate of bearing surface area which is a multiple of my previous bearing design. As will be understood, the increase in bearing surface area facilitates a reduction in bearing surface wear. Accordingly, maintenance on the thrust bearing assembly is reduced and the overall durability of the hinge structure is enhanced. Because the thrust bearing assembly of the present invention has a one-piece design, there is no increase in the number of parts to be handled during assembly of the hinge structure.

Numerous other features and advantages of the following detailed description, the accompanying drawings, and the appended claims.

DETAILED DESCRIPTION OF A PREFERRED EMBODIMENT

Figure 1:
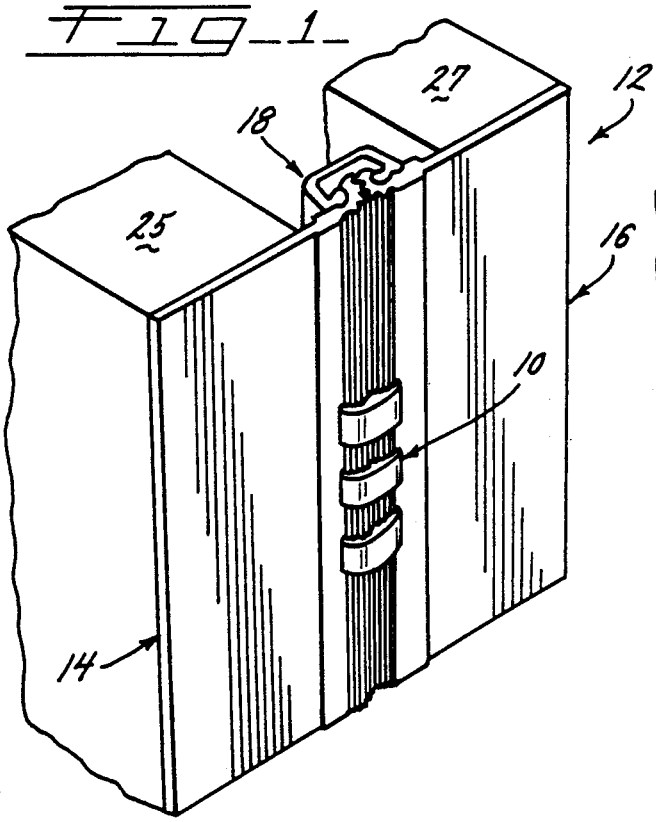
FIG. 1 is a fragmentary perspective view of an advantageous form of a thrust bearing assembly according to the present invention as arranged in combination with a hinge structure.

While the present invention is susceptible of embodiment in various forms, there is shown in the drawings, and will hereinafter be described, a preferred embodiment with the understanding that the present disclosure is to be considered as an exemplification of the invention and is not intended to limit the invention to the specific embodiment illustrated.

Referring now to the drawings, wherein like reference numerals indicate like parts throughout the several views, a thrust bearing assembly 10 is schematically illustrated in combination with a hinge structure 12. The hinge structure 12 comprises first and second longitudinally extending hinge members or leaves 14, 16 which are rotatably joined to each other. A longitudinally extending clamp member 18 maintains the hinge members 14, 16 in rotatable association relative to each other throughout their range of movement.

The hinge members can be formed from a wide variety of metals, plastics, and other materials and can be fabricated by machining the members from stock of appropriate cross section, or by rolling, drawing, die casting, or preferably, by extruding these materials. In the later case, any extrudable material of the requisite strength may be employed such as brass, aluminum, thermoplastic polymers, and the like.

Figure 2:
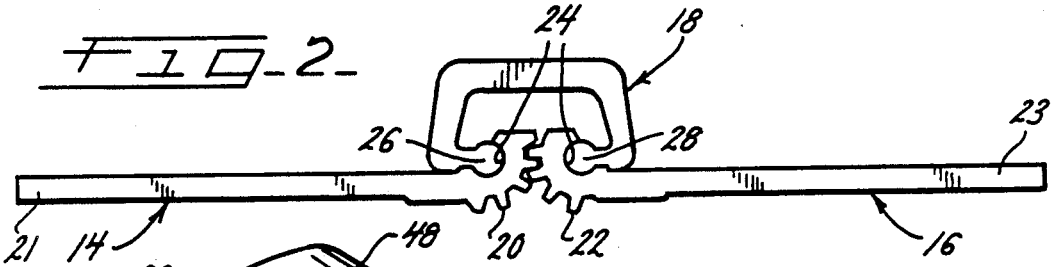
FIG. 2 is an enlarged top plan view of the hinge structure illustrated in FIG. 1.

As illustrated in FIG. 2, the hinge members are rotatably joined along adjacent longitudinal edges. Although the illustrated configuration of the hinge members 14, 16 allows them to rotate through an arc of travel extending about 180 degrees between open and closed positions, it should be appreciated that the principles of the present invention equally apply to other hinge structures. For example, the principles of the present invention are readily applicable to a pinless hinge structure which is rotatable through an extended arc of travel such as that disclosed in my copending patent application filed on Nov. 6, 1989 under Ser. No. 432, 587; the full teachings of which are incorporated herein by reference. Alternatively, the principles of the present invention can be applied to a pinless hinge structure wherein each of the hinge members has a shifting axis of rotation such as that disclosed in my co-pending patent application filed on Nov. 13, 1989 under Ser. No. 434,312; the full teachings of which are incorporated herein by reference.

In a most preferred form, the first hinge member 14 is formed with a longitudinally extending gear segment or portion 20 at one longitudinal edge and has an outwardly extending leg portion 21 integrally formed therewith. A longitudinal edge of the second hinge member 16 is similarly formed with a longitudinally extending gear segment or portion 22 which is in mutual intermeshing relation with gear segment 20 on hinge 14. Hinge member 16 further includes an outwardly extending leg portion 23 formed integrally with the gear segment 22. As illustrated in FIG. 1, the leg portions 21, 23 of the hinge members 14, 16, respectfully, are secured to door panels 25, 27 or the like by any suitable fastener means such as screws or the like.

Each gear segment 20, 22 defines a longitudinally extending channel 24 which provides each gear segment with a longitudinally extending cylindrical bearing surface which coincides with the axes of rotation of the respective gear segment 20, 22. As shown in FIG. 2, the gear teeth of the gear segments 20, 22 intermesh to rotatably join the hinge members 14, 16 to each other.

As best seen in FIG. 2, the longitudinally extending clamp member 18 has a generally channel-shaped or C-shaped cross section. The inwardly turned ends of the clamp member 18 are formed with longitudinally extending rod-like bearing portions 26 and 28 which contact and cooperate with the cylindrical bearing surfaces defined by channels 24 at the axis of rotation of hinge members 12, 14.

Although the members which comprise the hinge structure are interconnected by longitudinal engagement of the gear segments 20, 22, and by the longitudinal engagement of the rod-like bearing portions 26 and 28 with the channels 24, the hinge members 14 and 16 are not in any way longitudinally interconnected. As a result, there is nothing, apart from friction, to prevent relative longitudinal movement of the hinge members 14, 16 to each other.

The thrust bearing assembly 10 of the present invention inhibits longitudinal movement of the hinge members 14, 16 relative to each other. As may be appreciated, more than one thrust bearing assembly may be provided along the length of the hinge structure to distribute the load-bearing capability of the hinge structure over the length thereof. For purposes of discussion, however, only one thrust bearing assembly will be discussed in detail with the understanding that other thrust bearing assemblies may be substantially similar in construction.

Figure 3:
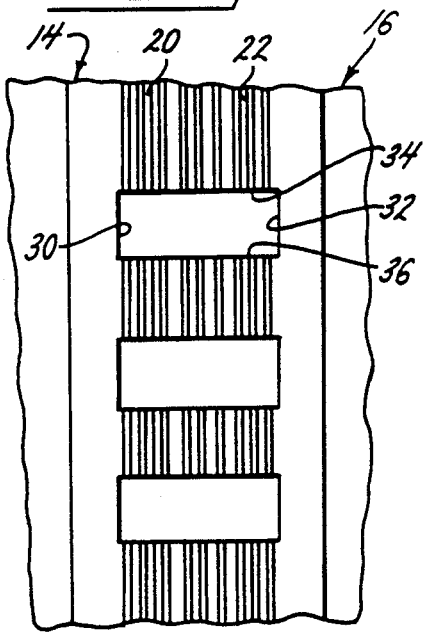
FIG. 3 is an enlarged fragmentary elevational view of the hinge structure of FIG. 1 with the thrust bearing assembly of the present invention removed therefrom.

Turning to FIG. 3, the hinge members 14, 16, define a plurality of longitudinally spaced recesses which are adapted to accommodate a thrust bearing assembly of the present invention. As will be described hereinafter, the number of recesses provided in the hinge members will be governed by the design of the thrust bearing assembly. In that each of the recesses are substantially similar, only the top most recess will be described in detail with the understanding that the other recesses are substantially similar. Each recess is defined by a pair of coextensive lateral slots or notches 30 and 32 defined along adjacent longitudinal edges of the hinge members 14, 16. The lateral slots or notches 30, 32 provides each recess with upper and lower laterally extending marginal surfaces 34 and 36, respectively.

Figure 4:
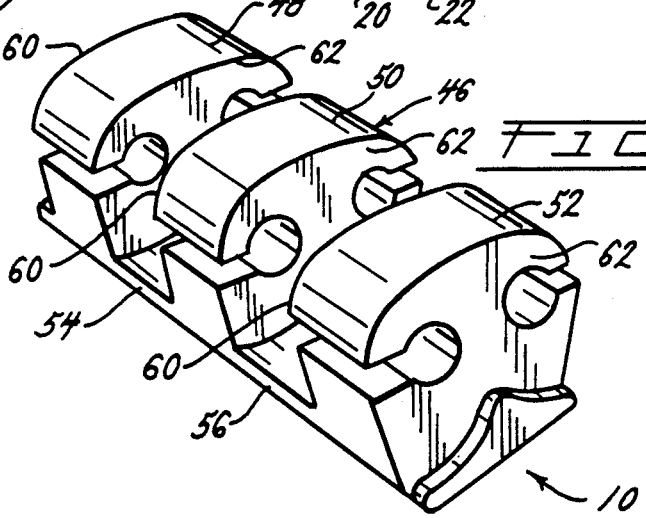
FIG. 4 is a perspective view of the thrust bearing assembly of the present invention.
Figure 5:
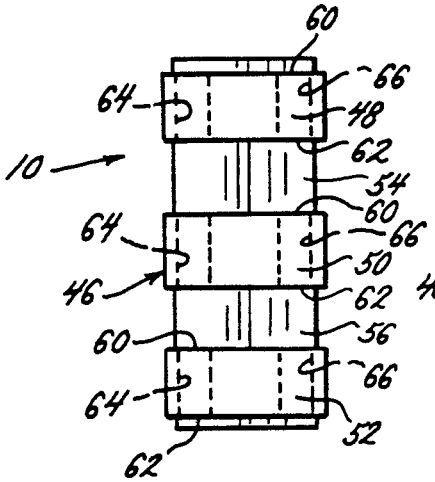
FIG. 5 is an elevational view of the thrust bearing assembly of the present invention.
Figure 6:
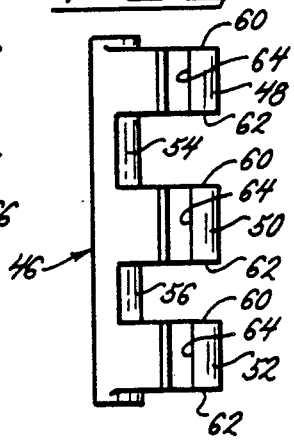
FIG. 6 is a side elevational view of the thrust bearing assembly.
Figure 7:
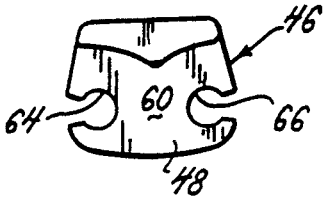
FIG. 7 is a plan view of the thrust bearing assembly.

The thrust bearing assembly 10 of the present invention is provided to inhibit relative longitudinal movement between the hinge members 14, 16 of the hinge structure. As illustrated in FIGS. 4 through 6, the thrust bearing assembly 10 includes a thrust bearing member 46 having a plurality of longitudinally spaced lateral projections 48, 50 and 52 which are joined to each other by webs 54 and 56. Preferably, the thrust bearing member 46 is a one-piece molded design that is from a nonmetallic material such as acetal resin-type plastic. Such material is commonly sold under the trade name "Delrin" by DuPont Corporation.

The projections 48, 50 and 52 substantially correspond in configuration to each other and each includes upper and lower generally planar support surfaces 60 and 62 which extend across adjacent longitudinal edges of the hinge members 14, 16 when the bearing assembly 10 is received in the recesses defined by the hinge members. The ratio of the distance between each pair of support surfaces 60 and 62 and the length of the overall bearing member 46 is selected to inhibit twisting of the thrust bearing member thereby improving its alignment with the gear segments 20 and 22. In other words, the bearing member 46 is considerably longer than the height of any one of its projections 48, 50, 52, and whereas the projections 48, 50, 52, if separate and detached from each other might twist under load, when united into the bearing member 46 of greater longitudinal dimension, they experience less twisting. Each projection 48, 50, 52 on the thrust bearing member further defines a pair of longitudinally extending channels 64 and 66 that receive the rod-like bearing portions 26 and 28 of the clamp member 18 and through which these rod-like bearing portions longitudinally extend through the recesses.

Although the thrust bearing member 10 of the present invention preferably is formed as a one-piece molded design, it should be appreciated that the thrust bearing assembly may use inserts arranged between each of the projections 48, 50 and 52 and the upper and lower marginal surfaces 34, 36, respectively, of each recess formed in the hinge members. The provision of such inserts is in accordance with the principles disclosed in my copending patent application filed on Nov. 6, 1989 under Ser. No. 432,575; the full teachings of which are incorporated herein by reference.

Figure 8:
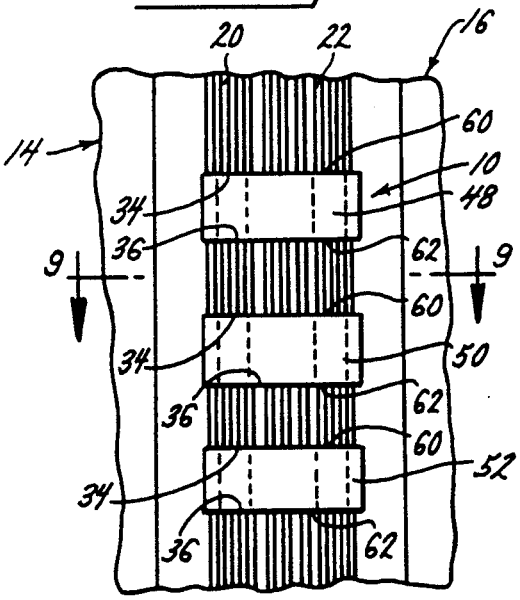
FIG. 8 is an enlarged fragmentary elevational view of the hinge structure of FIG. 1 with the thrust bearing assembly of the present invention inserted therein.

As illustrated in FIG. 8, the projections 48, 50, 52 or the thrust bearing member 46 are removably accommodated within the recesses defined along adjacent longitudinal edges of the hinge members 14 and 16. The longitudinal dimension between the upper and lower support surfaces 60, 62, respectively, of each projection and the longitudinal distance separating the upper and lower marginal surfaces 34, 36, respectively, of each recess formed in the hinge members are such that there is just sufficient clearance therebetween to permit the hinge members 14, 16 to swing or be rotated in an arcuate path of travel without binding on the thrust bearing assembly. Moreover, each recess in the hinge members is laterally dimensioned to permit the hinge members 14, 16 to be rotated between open and closed positions without bending on the thrust bearing assembly.

Figure 9:
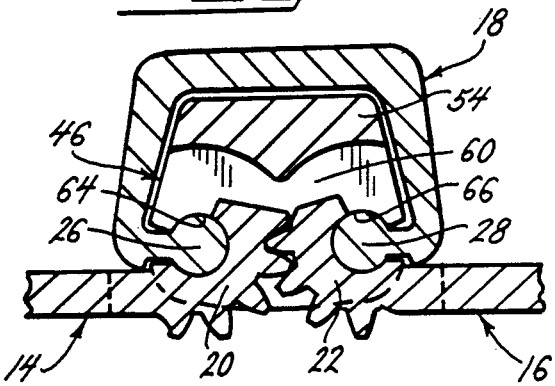
FIG. 9 is a sectional view taken along line 9—9 of FIG. 8 and illustrating hinge members of the hinge structure in an open position.

Each of the webs 54, 56 provided to longitudinally connect the projections 48, 50 and 52 on the bearing member to each other, has a cross-sectional configuration which is strong enough to resist breakage because of loading placed upon the projections by the hinge members 14, 16. As illustrated in FIG. 9, each web is optimally formed as a radius of a dimension equal to the tip radius of either gear segments 20, 22.

Figure 10:
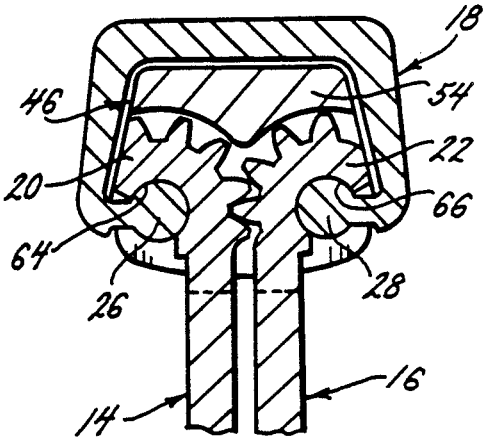
FIG. 10 is a sectional view similar to FIG. 9 illustrating the hinge members in a closed position.

As illustrated in FIGS. 9 and 10, the thrust bearing member 46 advantageously has a cross-sectional configuration that conforms essentially to the cross-sectional configuration of the interior of clamp member 18. The cross-sectional configuration of the thrust bearing member 46 provides each of the lateral projections with a relatively large planar surface area for supporting the hinge members 14, 16, whether the hinge members are in an open position (FIG. 9) or a closed (FIG. 10) position.

The bearing surfaces 60, 62 on each projection extends across the adjacent longitudinal edges of the hinge members 14, 16 so as to effectively inhibit relative longitudinal movement therebetween. A salient feature of the present invention is its ability to substantially increase the bearing surface area and thereby reduce frictional sliding contact between the hinge members and the bearing member without substantially reducing the lateral strength of the hinge structure.

The labor costs involved in fabricating the present invention are not significantly higher than with my previous design in that the machining operations for effecting the present invention are essentially the same. For example, in my patented design, a lateral recess having a longitudinal dimension of $\frac{3}{4}$ inch was machined into adjacent longitudinal edges of the hinge members. With my new design, three longitudinally spaced recesses, each having a $\frac{1}{4}$ inch longitudinal dimension can be formed with $\frac{1}{4}$ inch cutters stacked with two $\frac{1}{4}$ inch spacers mounted between them. Accordingly, the same machinery operation is performed.

Although the cumulative length (1 ¼ inch) between the upper marginal edge of the uppermost recess and the lower marginal edge of the lowermost recess increases with the design of the present invention, no additional material is removed from the hinge members than with the old design. Moreover, the bearing of the present design maintains better alignment (resistance to twist) while at the same time providing an aggregate of bearing surface area which is a multiple of the original thrust bearing design. That is, the design of the present invention improves the bearing members resistance to twist, provides more total bearing surface area and has no increase in the number of parts to be handled during assembly of the hinge structure.

From the foregoing, it will be observed that numerous modifications and variations can be effected without departing from the true spirit and scope of the novel concept of the present invention. It is to be understood that no limitation with respect to the specific embodiment is intended or should be inferred. The disclosure is intended to cover by the appended claims all such modifications as fall within the scope of the claims.

What is claimed is:

1. A thrust bearing assembly for and in combination with a pinless hinge structure including two longitudinally extending geared hinge members and a clamp member, said geared hinge members being rotatably joined to each other and having a plurality of recesses, each of which is common to the two hinge members, said clamp member holding the gear members together so that they do not separate laterally, said thrust bearing assembly comprising:

a thrust bearing member having multiple projections which are joined longitudinally to each other and extend into the recess where they are provided with bearing support surfaces that extend laterally across adjacent longitudinal edges of said hinge member to inhibit relative longitudinal movement between said hinge members, each bearing member corresponding in cross-sectional configuration substantially to the interior of the clamp member and being long enough to inhibit twisting of the bearing member.

2. The thrust bearing member assembly according to claim 1 wherein said bearing support surfaces are nonmetallic to reduce sliding friction between said trust bearing member and said hinge members.

3. A thrust bearing assembly for and in combination with a pinless hinge structure including two longitudinally extending geared hinge members which are rotatably joined to each other and a clamp member for holding the gear members together so that they do not separate laterally, said thrust bearing assembly comprising:

a thrust bearing member having a series of longitudinally spaced lateral projections which are substantially fixed in position with respect to each other on the bearing member and extend through a series of longitudinally spaced, coextensive lateral recesses defined along adjacent longitudinal edges of said hinge members so that each recess lies in both of the hinge members, each of said projections on said bearing member defining upper and lower bearing support surfaces which extend across the upper and lower margins of a respective lateral recess to inhibit longitudinal movement of the hinge members relative to each other, the bearing member also having a web connecting the projections and being located within the clamp member, the web having concave surfaces which conform to and receive the gear segments on the hinge members.

4. The thrust bearing assembly for a pinless hinge structure according to claim 3 wherein each projection on said thrust bearing member defines a pair of longitudinal channels which accommodate inwardly turned ends of said clamp member.

5. The thrust bearing assembly for a pinless hinge structure according to claim 3 wherein each projection has a length substantially equal to a distance separating upper and lower surfaces of a respective lateral recess.

6. A thrust bearing assembly for and in combination with a hinge structure including two longitudinally extended and intermeshed geared hinge members which are longitudinally movable relative to each other, unless restrained, and a clamp member for maintaining the geared hinge members in mesh as they rotate, each geared hinge member including a gear segment extending along a longitudinal edge thereof, said bearing assembly comprising:

a longitudinally extended bearing member with at least two longitudinally joined and spaced lateral projections extending through longitudinally spaced lateral recesses defined along adjacent longitudinal edges of said hinge members, each of said projections being joined to another by a web configured with a cross-sectional thickness which resists breakage when a cantilevered force is applied by either hinge member to the projection joined thereto, and wherein each projection extends across the adjacent longitudinal edges of the hinge members to inhibit longitudinal displacement of one hinge member relative to the other, the bearing member being formed from a non-metallic material.

7. The thrust bearing assembly according to claim 6 wherein said web is formed as a radius of a dimension generally equal to the radius of said gear segments on said hinge members.

8. The thrust bearing assembly according to claim 6 wherein each projection on said bearing member includes two longitudinally extended channels which receive inwardly turned end portions of said clamp member.

9. A hinge comprising: first leaf formed from metal and having a gear segment along one of its longitudinal edges and notches which open laterally out of the gear segment; a second leaf formed from metal and having a gear segment along one of its longitudinal edges and notches which opens laterally out of its gear segment, the gear segment of the second leaf being coupled with the gear segment of the first leaf so that the second leaf can rotate relative to the first leaf, the notches in the second leaf opening into the notches in the first leaf; a clamp engaged with the gear segments of the leaves and holding the gear segments together while permitting the second leaf to rotate relative to the first leaf; a bearing member extended along the gear segments and having a plurality of projections which fit into the notches of the leaves to prevent the leaves from being disposed longitudinally with respect to each other, the bearing member further having reduced web sections located between adjacent projections and generally preventing the projections from twisting with respect to each other, the bearing member being formed from a nonmetallic material with each of its projections being thicker than the leaves.

10. A hinge according to claim 9 wherein the bearing member is confined laterally by the clamp member at a location beyond the projection.

11. A hinge according to claim 9 wherein the bearing member is between and confined by the clamp member such that the clamp member resists twisting of the bearing member.

12. A hinge according to claim 9 wherein the reduced web sections of the bearing member have concave surfaces which generally conform to and receive the gear segments on the leaves.

13. A hinge according to claim 12 wherein the leaves at their gear segments have channels which open laterally; wherein the clamp member spans the gear segments and has rod-like bearing portions which fit into the channels of the leaves; and wherein the projections on the bearing member, along their sides, have channels which also receive the rod-like bearing portions of the clamp member.

14. A hinge according to claim 9 wherein the bearing member is formed from a polymer.

15. A hinge according to claim 9 wherein the gear segments mesh.

* * * * *

UNITED STATES PATENT AND TRADEMARK OFFICE

CERTIFICATE OF CORRECTION

PATENT NO. : 4,999,878

DATED : Mar. 19, 1991

INVENTOR(S) : Austin R. Baer

It is certified that error appears in the above-identified patent and that said Letters Patent is hereby corrected as shown below:

Column 3, line 29, after "the" insert --- present invention will become readily apparent from the ---

Claim 1, Column 7, line 35, delete "recess" and insert --- recesses ---

Claim 2, Column 7, line 46, delete "trust" and insert --- thrust ---

Claim 9, Column 8, line 60, delete "disposed" and insert --- displaced ---

Signed and Sealed this

Ninth Day of November, 1993

Bruce Lehman

*Attest:*

BRUCE LEHMAN

*Attesting Officer*

*Commissioner of Patents and Trademarks*